US007623008B2

(12) United States Patent
Murano

(10) Patent No.: US 7,623,008 B2
(45) Date of Patent: Nov. 24, 2009

(54) PHASE SHIFTER COMPRISING A COUPLING LINE FOR PROVIDING DIVIDED PATHS OF DIFFERENT PATH LENGTHS

(75) Inventor: Shinsuki Murano, Kasama (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

(21) Appl. No.: 11/968,928

(22) Filed: Jan. 3, 2008

(65) Prior Publication Data

US 2008/0297273 A1 Dec. 4, 2008

(30) Foreign Application Priority Data

May 31, 2007 (JP) ..... 2007-145340

(51) Int. Cl.
*H01P 1/18* (2006.01)

(52) U.S. Cl. ..... 333/161

(58) Field of Classification Search ..... 333/161, 333/156, 164

See application file for complete search history.

(56) References Cited

U.S. PATENT DOCUMENTS 6,043,722 A * 3/2000 Vaninetti et al. ..... 333/128
6,831,602 B2 * 12/2004 McKinzie et al. ..... 342/375
6,989,788 B2 * 1/2006 Marion et al. ..... 342/375
6,992,539 B1 * 1/2006 How ..... 333/24.1
2005/0285701 A1 12/2005 Kayano et al.

FOREIGN PATENT DOCUMENTS

JP 5-014004 A 1/1993
JP 2001-237605 A 8/2001
JP 2003-198217 A 7/2003
JP 2006-14068 A 1/2006

* cited by examiner

*Primary Examiner*—Benny Lee
(74) *Attorney, Agent, or Firm*—Foley & Lardner LLP

(57) ABSTRACT

A first microstrip line 100 transmits a predetermined input signal. A coupling line includes a gap 120 along a transmitting direction of the input signal, and the gap 120 forms a plurality of paths having different path lengths. The input signal is divided by the gap 120 into divided signals. The paths are electrically coupled to the first microstrip line 100 at a first region to transmit the divided signals. A second microstrip line 105 is provided in parallel with the first microstrip line and electrically coupled to the coupling line at a second region. The second microstrip line 105 transmits each of the divided signals transmitted through the coupling line.

7 Claims, 7 Drawing Sheets

PHASE SHIFTER COMPRISING A COUPLING LINE FOR PROVIDING DIVIDED PATHS OF DIFFERENT PATH LENGTHS

The present application is based on Japanese Patent Application No. 2007-145340 filed on May 31, 2007, the entire contents of which are incorporated herein by reference.

BACKGROUND OF THE INVENTION

1. Field of the Invention

The present invention relates to a phase shifter, in more particular, to a transmission line phase shifter.

2. Related Art

As a phase shifter used for beam control or phase modulation of a phased array antenna, a transmission line phase shifter has been conventionally used. For example, Japanese Patent Laid-Open No. 5-14004 discloses a phase adjustment circuit, comprising a first substrate, a U-shaped pattern formed on the first substrate, a second substrate, and first and second patterns formed on the second substrate, each of the first and second patterns having a part provided in parallel with each other, in which parallel parts in the U-shaped pattern are overlapped with the parallel patterns of the first and second patterns to contact to each other, and the first and second substrates are configured to be continuously movable.

According to the phase adjustment circuit disclosed by Japanese Patent Laid-Open No. 5-14004, a length of the U-shaped pattern is determined as a length of an integral multiplication of a ½ wavelength of a signal to be transmitted, so that the first and second substrates are continuously movable in a state where the respective parallel parts in the U-shaped pattern are overlapped with and in contact with the parallel patterns of the first and second patterns. According to this structure, in the phase adjustment circuit of Japanese Patent Laid-Open No. 5-14004, it is possible to continuously change a transmission path length of the signal, so as to continuously change a signal phase while confirming circuit characteristics.

In addition, Japanese Patent Laid-Open No. 2001-237605 discloses a phase shifter, comprising a first dielectric substrate, a plurality of input side microstrip lines and a plurality of output side microstrip lines provided on the first dielectric substrate, a second dielectric substrate which is movable with respect to the first dielectric substrate, a plurality of coupling microstrip lines provided on the second dielectric substrate, and an insulator provided between the first dielectric substrate and the second dielectric substrate, in which a plurality of the input side microstrip lines and a plurality of the output side microstrip lines are overlapped with a plurality of the coupling microstrip lines respectively to be facing to each other.

According to the phase shifter disclosed by Japanese Patent Laid-Open No. 2001-237605, it is possible to change lengths of overlapped portions, in which a plurality of the input side microstrip lines and a plurality of the output side microstrip lines are overlapped with a plurality of the coupling microstrip lines via the insulator, simultaneously with a constant proportion. According to this structure, it is possible to change phases of the signals transmitted through the input side microstrip lines the respective coupling microstrip lines at the same time. For example, the phase shifter disclosed by Japanese Patent Laid-Open No. 2001-237605 may be installed in an array antenna used for an antenna for a portable telephone base station as an apparatus for changing a directivity orientation.

However, in the phase adjustment circuit disclosed by Japanese Patent Laid-Open No. 5-14004, a total length of the U-shaped pattern is previously set (fixed) as the length of the integral multiplication of the ½ wavelength of the signal to be transmitted.

In the phase shifter disclosed by Japanese Patent Laid-Open No. 2001-237605, a total length of a plurality of the coupling microstrip lines is previously set (fixed) as the length of the integral multiplication of the ½ wavelength of the wavelength of the signal to be transmitted respectively.

Therefore, in both of the phase adjustment circuit disclosed by Japanese Patent Laid-Open No. 5-14004 and the phase shifter disclosed by Japanese Patent Laid-Open No. 2001-237605, it is difficult to improve transmission characteristics and return loss characteristics when a signal at a frequency other than a frequency of the signal that is supposed to be used when designing the phase shifter.

SUMMARY OF THE INVENTION

Accordingly, so as to solve the above problem, an object of the present invention is to provide a phase shifter, in which a frequency band of a signal subject to the phase shift can be broadened.

According to a first feature of the invention, a phase shifter comprises:

a first microstrip line for transmitting an input signal;

a coupling line including a plurality of paths having different path lengths provided by a gap along a transmitting direction of the input signal, the paths being electrically coupled to the first microstrip line at a first region, for transmitting each of divided signals generated by dividing the input signal by the gap through each of the paths; and a second microstrip line provided in parallel with the first microstrip line and electrically coupled to the coupling line at a second region, for transmitting each of the divided signals transmitted through the coupling line.

In the phase shifter, the coupling line may have a configuration in that each of the paths is turned back. The coupling line may be formed on a dielectric substrate provided to be freely movable along the first microstrip line and the second microstrip line. The coupling line may comprise a conductive material provided on the dielectric substrate, and the conductive material is insulated for a direct current between the first microstrip line and the second microstrip line. The conductive material may comprise a metal foil or a metal plate.

According to a second feature of the invention, a phase shifter comprises:

an input terminal to which a predetermined input signal is input;

a distributor for distributing the input signal into plural distributed signals; and a plurality of phase shifters for converting a phase of each of the distributed signals into a predetermined phase, each of the phase shifters comprising:

a first port to which a part of the distributed signals is input;

a first microstrip line for transmitting the distributed signal input to the first input port;

a coupling line including a plurality of paths having different path length provided by a gap along a transmission direction of the distributed signal, the paths being electrically coupled to the first microstrip line at a first region, for transmitting each of divided signals generated by dividing the distributed signal by the gap through each of the paths; and a second microstrip line provided in parallel with the first microstrip line and electrically coupled to the coupling line at a second region, for transmitting the divided signals transmitted through the coupling line.

The phase shifter may further comprise:

an output terminal for outputting at least a part of the divided signals transmitted through the second microstrip line;

each of a plurality of the phase shifters further comprising:

a second port for outputting each of the divided signals transmitted through the second microstrip line to a divider, the divider dividing the plural divided signal into plural partial divided signals, outputting a part of the partial divided signals to the output terminal as a part of the divided signals, and outputting another part of the partial divided signals to the first port of other phase shifter as the distributed signal.

In the phase shifter, the coupling line included in each of the phase shifters may comprise a conductive material provided on a dielectric substrate, the conductive material is insulated for a direct current between the first microstrip line and the second microstrip line. The conductive material may comprise a metal foil or a metal plate.

According to the present invention, it is possible to broaden the frequency band of the signal subject to the phase shift.

BRIEF DESCRIPTION OF THE DRAWINGS

Next, the present invention will be explained in more detail in conjunction with appended drawings, wherein:

FIGS. 1A and 1B are plan views of a phase shifter upper part and a phase shifter lower part in a first preferred embodiment according to the present invention, wherein FIG. 1A is a plan view of the phase shifter lower part in the first preferred embodiment, and FIG. 1B is a plan view of the phase shifter upper part in the first preferred embodiment;

FIGS. 2A and 2B are plan views of a phase shifter in the first preferred embodiment, wherein FIG. 2A is a plan view of the phase shifter in the first preferred embodiment, and FIG. 2B is a cross sectional view of the phase shifter in the first preferred embodiment;

FIGS. 4A and 4B are schematic diagrams showing a conventional phase shifter and the phase shifter in the first preferred embodiment, wherein FIG. 4A is a schematic diagram of the conventional phase shifter, and FIG. 4B is a schematic diagram of the phase shifter in the first preferred embodiment;

FIGS. 5A and 5B are graphs showing transmission characteristics and voltage standing wave ratio (VSWR) of the conventional phase shifter and the phase shifter in the first preferred embodiment, wherein FIG. 5A is a graph showing comparison between the transmission characteristics (S21) of the conventional phase shifter and the transmission characteristics (S21) of the phase shifter in the first preferred embodiment, and FIG. 5B is a graph showing a comparison between the VSWR of the conventional phase shifter and the VSWR of the phase shifter in the first preferred embodiment;

DESCRIPTION OF THE PREFERRED EMBODIMENTS

Next, preferred embodiments according to the present invention will be explained in more detail in conjunction with the appended drawings.

First Preferred Embodiment

Figure 1B:
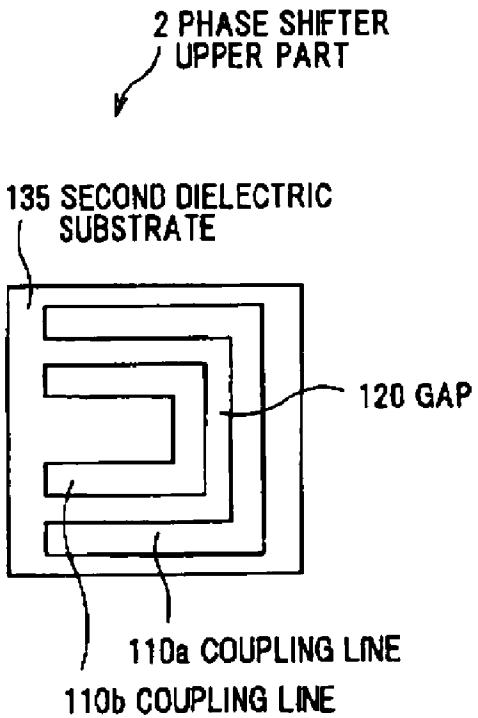
Figure 1A:
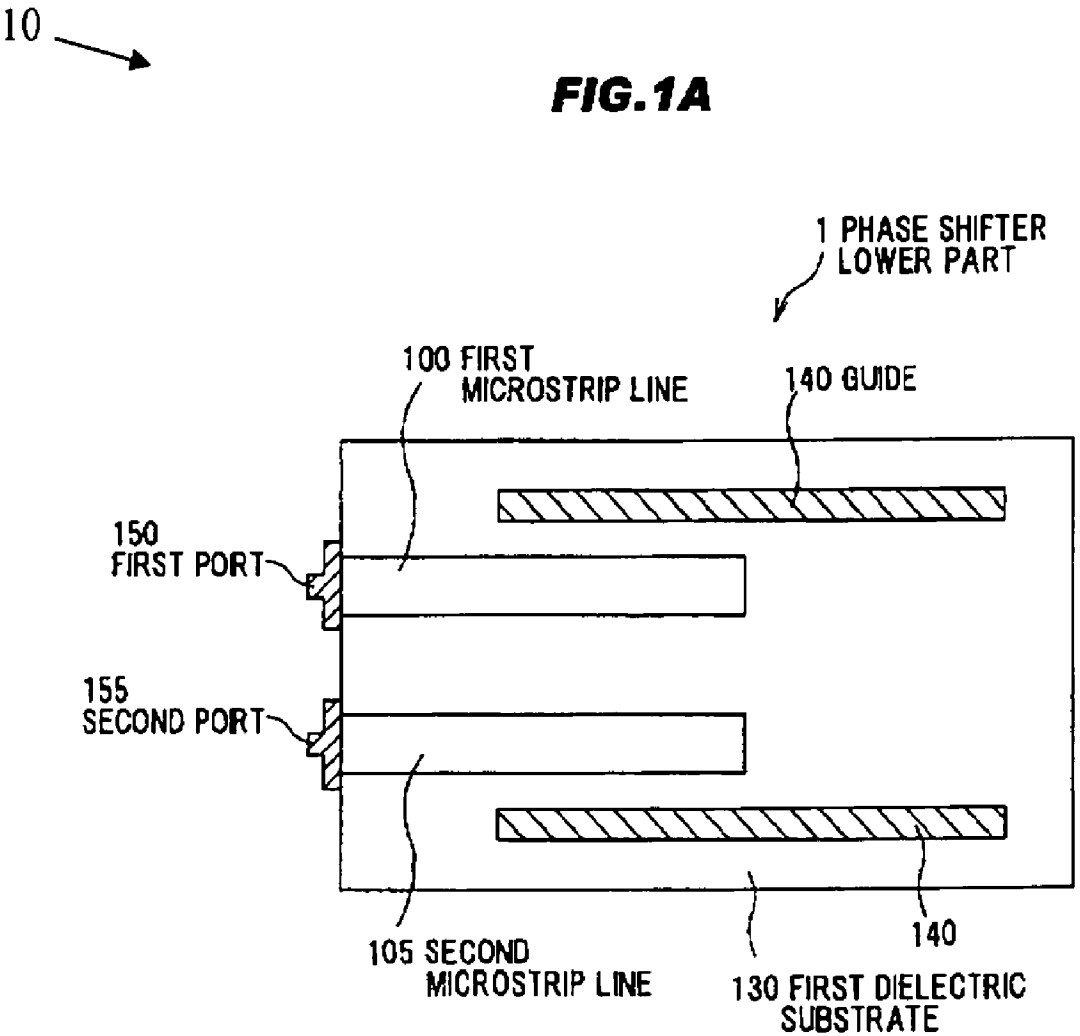

FIGS. 1A and 1B are plan views of a phase shifter upper part and a phase shifter lower part in a first preferred embodiment according to the present invention, in which FIG. 1A is a plan view of the phase shifter lower part in the first preferred embodiment, and FIG. 1B is a plan view of the phase shifter upper part in the first preferred embodiment.

In addition, FIG. 1B shows a phase shifter upper part 2 viewed from a side of a surface that is facing a surface on which a first microstrip line 100 and a second microstrip line 105 provided at a phase shifter lower part 1 as shown in FIG. 1A, is formed.

(Structure of a Phase Shifter 10)

A phase shifter 10 in this preferred embodiment comprises the phase shifter lower part 1 and the phase shifter upper part 2.

As shown in FIG. 1A, the phase shifter lower part 1 comprises a first dielectric substrate 130, a first microstrip line 100 provided at a predetermined region on the first dielectric substrate 130 for transmitting a predetermined input signal, and a second microstrip line 105 provided substantially in parallel with the first microstrip line 100 at another predetermined region on the first dielectric substrate 130.

The phase shifter lower part 1 further comprises a pair of guides 140 provided substantially in parallel with the first microstrip line 100 and the second microstrip line 105 for movably holding the phase shifter upper part 2 along the first microstrip line 100 and the second microstrip line 105, a first port 150 provided at one end of the first microstrip line 100, and a second port 155 provided at one end of the second microstrip line 105.

As shown in FIG. 1B, the phase shifter upper part 2 comprises a second dielectric substrate 135 as a dielectric substrate, a first predetermined region including another end of the first microstrip line 100 (FIG. 1A) which is different from the one end of first microstrip line 100 (FIG. 1A) on which the first port 150 (FIG. 1A) is provided, a second predetermined region including another end of the second microstrip line 105 (FIG. 1A) which is different from the one end of second microstrip line 105 (FIG. 1A) on which the second port 155 (FIG. 1A) is provided, and coupling lines 110*a*, 110*b*, each of which is electrically coupled to the first predetermined region and the second predetermined region. Between the coupling line 110*a* and the coupling line 110*b*, a gap 120 is provided as a slit with a predetermined interval to be provided along a transmitting direction of the input signal.

Figure 2A:
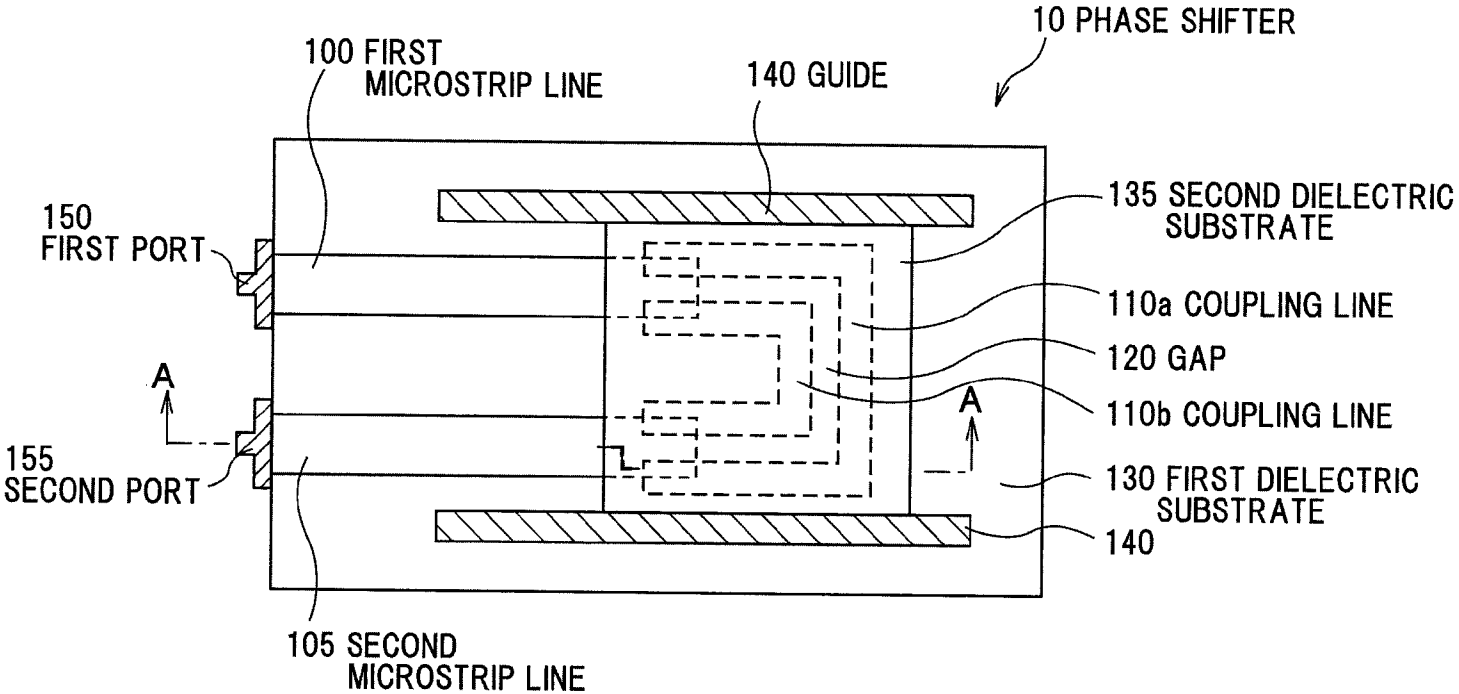
Figure 2B:
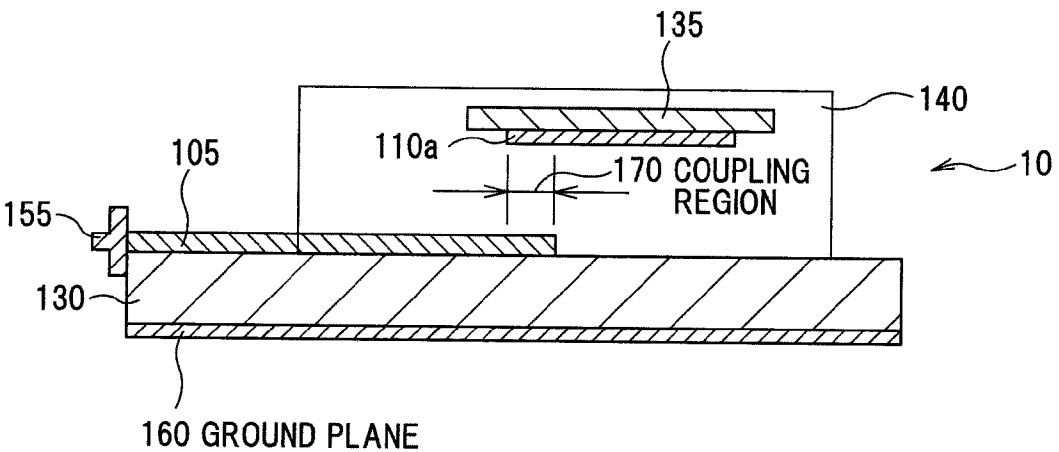

FIGS. 2A and 2B are plan views of a phase shifter 10 in the first preferred embodiment, wherein FIG. 2A is a plan view of the phase shifter in the first preferred embodiment, and FIG. 2B is a cross sectional view of the phase shifter along A-A line in the first preferred embodiment.

The first dielectric substrate 130 mainly comprises a PPE (polyphenylene ether) having a dielectric constant of 3.7, and has a substantially rectangular shape in a plan view. As to a plane dimension of the first dielectric substrate 130, a vertical dimension is 60 mm, and a lateral dimension is 170 mm. A thickness of the first dielectric substrate 130 is 1.6 mm.

As shown in FIG. 2B, a ground conductor (GND) 160 is provided on a lower surface of the first dielectric substrate 130, namely on a surface opposite to a surface on which the first microstrip line 100 and the second microstrip line 105 are provided. The ground plane conductor 160 comprises, for example, copper, and has a substantially rectangular shape in the plan view. A plane dimension of the ground conductor 160 is substantially equal to the plane dimension of the first dielectric substrate 130, and a thickness of the ground conductor 160 is 35 μm.

The first microstrip line 100 (FIG. 2A) mainly comprises copper and provided on an upper surface of the dielectric substrate 130, namely on a surface opposite to a surface on which the ground conductor 160 is provided. The first microstrip line 100 (FIG. 2A) has a substantially rectangular shape in a plan view. As to a plane dimension of the first microstrip line 100 (FIG. 2A), a width is 3.4 mm, a length is 110 mm, and a thickness is 35 μm. Further, the first microstrip line 100 (FIG. 2A) is impedance matched at 50Ω.

The second microstrip line 105 mainly comprises copper and provided substantially in parallel with the first microstrip line 100 on an upper surface of the dielectric substrate 130, namely on the surface opposite to the surface on which the ground conductor 160 is provided. The second microstrip line 105 is formed on the dielectric substrate 130 with an interval of 10 mm from the first microstrip line 100.

Further, the second microstrip line 105 has a substantially rectangular shape in a plan view, and a plane dimension thereof is substantially equal to the plane dimension of the first microstrip line 100. Further, the second microstrip line 105 is impedance matched at 50Ω.

The first port 150 (FIG. 2A) is electrically connected with the first microstrip line 100 (FIG. 2A) at one end of the first microstrip line 100. The second port 155 is electrically connected with the second microstrip line 105 at one end of the second microstrip line 105. In addition, the first port 150 (FIG. 2A) and the second port 155 are fixed to the dielectric substrate 130, respectively. Each of another end of the first microstrip line 100 (FIG. 2A) to which the first port 150 (FIG. 2A) is not connected and another end of the second microstrip line 105 to which the second port 155 is not connected is provided as an open end.

The guide 140 mainly comprises an insulator such as polyethylene, TEFLON (registered trademark). The guides 140 are provided in parallel with the first microstrip line 100 and the second microstrip line 105. A pair of the guides 140 sandwich the first microstrip line 100 and the second microstrip line 105 on the first dielectric substrate 130. Specifically, one of the guides 140 and another of the guide 140 are disposed with an interval of 35 mm on the first dielectric substrate 130.

In this preferred embodiment, the second dielectric substrate 135 of the phase shifter upper part 2 (FIG. 1B) mainly comprises PPE having a dielectric constant of 3.7, and has a substantially rectangular shape in a plan view. As to a plane dimension of the second dielectric substrate 135, a vertical dimension is 29.8 mm, a lateral dimension is 32 mm, and a thickness is 1.6 mm.

Each of the coupling line 110*a* and the coupling line 110*b* comprises a conductive material. For example, each of the coupling line 110*a* and the coupling line 110*b* comprises a copper foil as a metallic foil, and has a turn-back part (returning part). In this preferred embodiment, each of the coupling line 110*a* and the coupling line 110*b* has the turn-back part in the middle of each path to have a substantially U-shape. In each of the coupling line 110*a* and coupling line 110*b*, a total length thereof is set to be an integral multiplication of a ½ wavelength of the input signal. For example, a length of the coupling line 110*a* along a transmission direction of the input signal, namely the total length of the coupling line 110*a* is 65 mm, and a length of the coupling line 110*b* along a transmission direction of the input signal, namely the total length of the coupling line 110*b* is 53 mm. Further, for example, a width of each of the coupling line 110*a* and the coupling line 110*b* is 1.9 mm.

In this preferred embodiment, the coupling line 110*a* and the coupling line 110*b* (FIG. 2A) are formed at a predetermined interval to be in parallel with each other on the second dielectric substrate 135. In other words, a gap 120 (FIG. 2A) is formed along the transmission direction of the input signal between the coupling line 110*a* and the coupling line 110*b* (FIG. 2A) to provide the predetermined interval. In this preferred embodiment, the gap 120 (FIG. 2A) is continuously formed from one end to another end of each of the coupling line 110*a* and the coupling line 110*b* (FIG. 2A). For example, a width of the gap 120 (FIG. 2A) is 0.8 mm.

Next, as shown in FIG. 2A, in the phase shifter 10 in this preferred embodiment, the phase shifter upper part 2 (FIG. 1B) is held by a pair of the guides 140 of the phase shifter lower part 1 (FIG. 1A). The coupling line 110*a* and the coupling line 110*b* are electrically connected to the first microstrip line 100 respectively above in a predetermined region including one end of the first microstrip line 100. The coupling line 110*a* and the coupling line 110*b* are electrically connected to the second microstrip line 105 respectively above a predetermined region including one end of the second microstrip line 105.

Specifically, the coupling line 110*a* and the coupling line 110*b* are physically separated and distant from the first microstrip line 100 and the second microstrip line 105 respectively, and disposed above the first microstrip line 100 and the second microstrip line 105. In other words, as shown in FIG. 2B, the coupling line 110*a* and the coupling line 110*b* are disposed with a predetermined distance from an upper surface of the first microstrip line 100 and an upper surface of the second microstrip line 105 respectively.

For example, in this preferred embodiment, a distance between the upper surfaces of the first microstrip line 100 and the second microstrip line 105 and lower surfaces of the coupling line 110*a* and the coupling line 110*b* is 30 μm. At a coupling region 170 formed between the upper surfaces of the first microstrip line 100 and the second microstrip line 105 and the lower surfaces of the coupling line 110*a* and the coupling line 110*b*, the first and second microstrip lines 100, 105 are galvanically-isolated (i.e. insulated for a direct current) from the coupling lines 110*a*, 110*b* while the first and second microstrip lines 100, 105 are coupled for an alternating current to the coupling lines 110*a*, 110*b*.

In addition, the phase shifter upper part 2 is held to be freely movable by the guides 140. Therefore, the coupling lines 110*a*, 110*b* provided on the phase shifter upper part 2 freely moves along the first microstrip line 100 and the second microstrip line 105. In other words, the phase shifter upper part 2 moves along a longitudinal direction of the first microstrip line 100 and the second microstrip line 105, while being held by the guides 140. In other instances, the coupling line 110*a* and coupling line 110*b* may be physically and directly in contact with the first microstrip line 100 and second microstrip line 105 to provide a conduction state.

In addition, the first dielectric substrate 130 may comprise a dielectric material or an insulator other than the PPE. For example, the first dielectric substrate 130 may comprise TEFLON (registered trademark) having a dielectric constant of 2.6 or an alumina having a dielectric constant of 9.5, and the dielectric constant of the material of the first dielectric substrate 130 may be appropriately selected. Further, the plane dimension and the thickness of the first dielectric substrate 130 are not limited to the above example, and may be changed appropriately. Further, the shape of the first dielectric substrate 130 in a plan view is not limited to the above example, and may be changed appropriately. The configuration of the first dielectric substrate 130 may be changed in accordance with the configuration of the ground conductor 160. The second dielectric substrate 135 may comprise a material other than the PPE, similarly to the first dielectric substrate 130. For example, the second dielectric substrate 135 may comprise a printed circuit board.

Further, each of the first microstrip line 100, the second microstrip line 105, the coupling line 110*a*, the coupling line 110*b*, and the ground conductor 160 may comprise a metal other than the copper, for example, gold, silver, aluminum, tungsten, platinum, palladium, nickel, titanium, and tantalum, or the like.

Still further, each of the first microstrip line 100, the second microstrip line 105, the coupling line 110*a*, the coupling line 110*b*, and the ground conductor 160 may comprise an alloy including at least one metal such as copper, gold, silver, aluminum, tungsten, platinum, palladium, nickel, titanium, and tantalum, or a conductive material such as conductive ceramic, and conductive polymer.

Each of the coupling line 110*a* and the coupling line 110*b* may be formed as a metal plate comprising a metal such as copper. This metal plate may be provided on the second dielectric substrate 135. In addition, the coupling line 110*a* and the coupling line 110*b* as the metal plates may not be provided on the second dielectric substrate 135. Instead of being formed on the second dielectric substrate 135, each of the coupling line 110*a* and the coupling line 110*b* may be independently held by the guide 140. The shape and dimensions of the coupling line 110*a* and the coupling line 110*b* are not limited to the above example. For example, the coupling line 110*a* and the coupling line 110*b* may be formed such that the turn-back part may comprise a predetermined curvature as well as a substantially right angle respectively. Further, the width of the coupling line 110*a* and the width of the coupling line 110*b* may be different from each other.

(Operation of the Phase Shifter 10)

Figure 3:
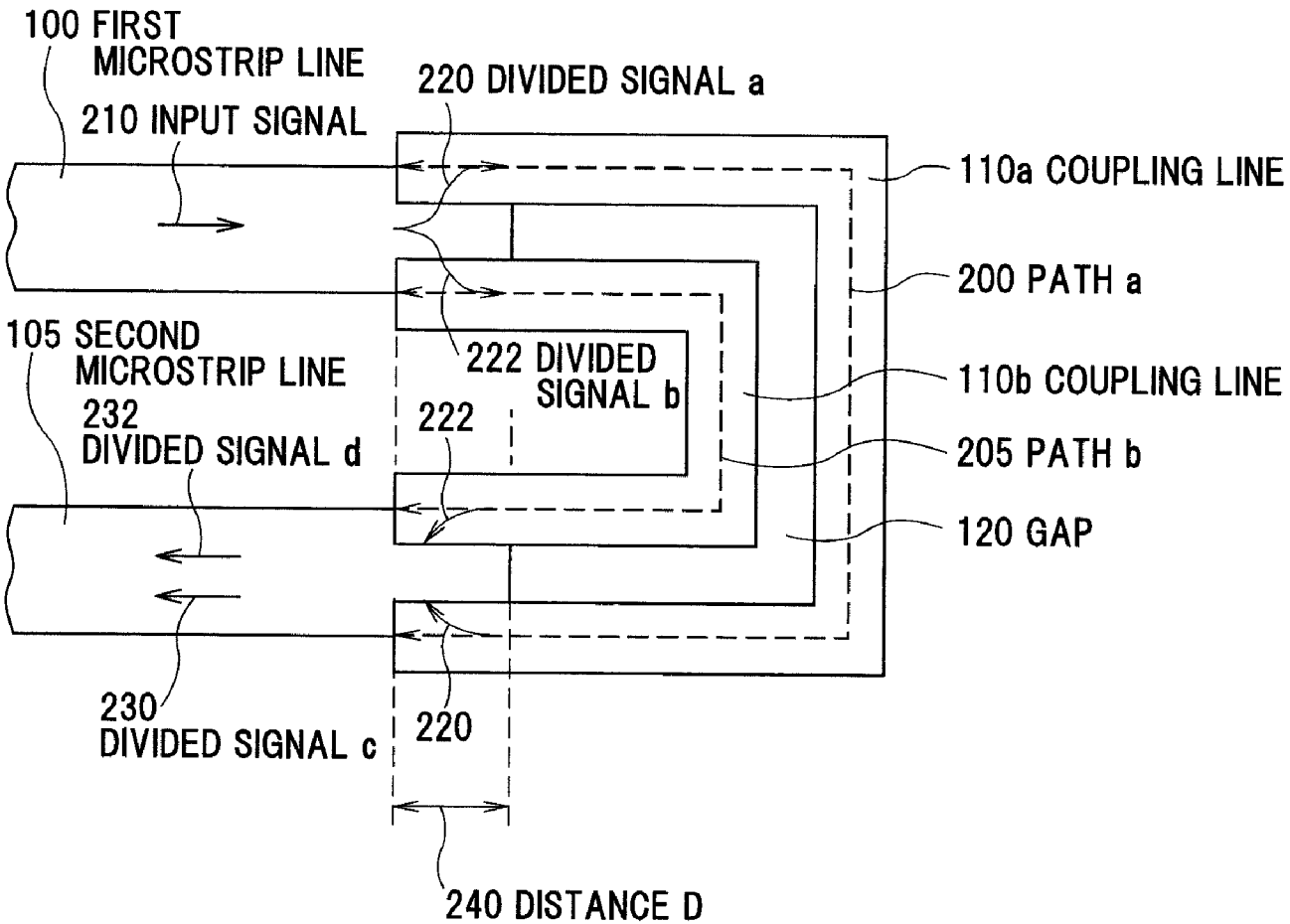
FIG. 3 is an explanatory diagram showing an example of operation of the phase shifter in the first preferred embodiment.

FIG. 3 is an explanatory diagram showing an example of operation of the phase shifter in the first preferred embodiment.

In FIG. 3, for the purpose of simplifying the explanation, illustration of several elements constituting the phase shifter 10, except the coupling line 110*a* and the coupling line 110*b*, and the first microstrip line 100 and the second microstrip line 105 that are necessary for explaining an operation of the phase shifter 10, is omitted.

At first, an input signal 210 is input as a predetermined input signal into the first microstrip line 100. Then, the input signal 210 is transmitted through the first microstrip line 100, and divided into a divided signal a 220 to be transmitted through the coupling line 110*a* and a divided signal b 220 to be transmitted through the coupling line 110*b* at one ends of the coupling line 110*a* and the coupling line 110*b*.

Herein, the coupling line 110*a* is isolated from the first microstrip line 100 for the direct current and overlapped with the first microstrip line 100 to be coupled for the alternating current (capacitive coupling) for a predetermined distance D 240 from the one end of the coupling line 110*a*, at a position above the one end of the first microstrip line 100. Similarly, the coupling line 110*b* is isolated from the first microstrip line 100 for the direct current and overlapped with the first microstrip line 100 to be coupled for the alternating current (capacitive coupling) for a predetermined distance D 240 from the one end of the coupling line 110*b*, at a position above the one end of the first microstrip line 100.

According to this structure, the input signal 210 transmitted through the first microstrip line 100 is divided into two divided signals, namely, the divided signal a 220 and the divided signal b 222 in a region that the first microstrip line 100 and the coupling line 110*a* are capacitively-coupled and a region that the first microstrip line 100 and the coupling line 110*b* are capacitively-coupled. The divided signal a 220 is transmitted through the coupling line 110*a*, and the divided signal b 222 is transmitted through the coupling line 110*b*.

In this preferred embodiment, the coupling line 110*a* and the coupling line 110*b* having different path lengths from each other are formed by forming a gap 120 along the transmitting direction of the signal in the coupling line that is conventionally formed as a single line configuration. In concrete, each of the coupling line 110*a* and the coupling line 110*b* has a U-shape having a turn-back portion in the middle of the path. The gap 120 is provided along the transmitting direction of the input signal 210 and the transmitting direction of the divided signal a 220 and the divided signal b 222 between the coupling line 110*a* and the coupling line 110*b*. According to this structure, a path length of a path a 200 of the coupling line 110*a* formed by the gap 120 and a path length of a path b 205 of the coupling line 110*b* formed by the gap 120 are different from each other.

In other words, the coupling line 110*a* sandwiches the gap 120 outside the coupling line 110*b*, so that the path length of the path a 200 is longer than the path length of the path b 205. This is because that the gap 120 is provided between the coupling line 110*a* and the coupling line 110*b*, and each of the coupling line 110*a* and the coupling line 110*b* has a U-shape having a turn-back portion in the middle of the path, so that there is a difference in the path lengths of the paths for transmitting the signals. Further, since the path length of the coupling line 110*a* and the path length of the coupling line 110*b* are different from each other, a resonant frequency for the coupling line 110*a* and a resonant frequency for the coupling line 110*b* are different from each other.

Subsequently, the divided signal a 220 transmitted through the path a 200 in the coupling line 110*a* is transmitted as a divided signal c 230 from the coupling line 110*a* to the second microstrip line 105. In such a case, a phase of the divided signal c 230 is converted into a phase which is different from the phase of the divided signal a 220 in accordance with the path length of the path a 200. Similarly, the divided signal b 222 transmitted through the path b 205 in the coupling line 110*b* is transmitted as a divided signal d 232 from the coupling line 110*b* to the second microstrip line 105. In such a case, a phase of the divided signal d 232 is converted into a phase which is different from the phase of the divided signal b 222 in accordance with the path length of the path b 205.

Specifically, the phase of the divided signal a 220 and the phase of the divided signal b 222 are shifted by $(2\times L)/\lambda$, when the distance D 240 of the capacitive coupling between the coupling line 110*a* and the coupling line 110*b*, and between the first microstrip line 100 and the second microstrip line 105 is L. In this case, $\lambda$ is an equivalent wavelength of a signal transmitting through the first dielectric substrate 130 having a predetermined dielectric constant.

Figure 4A:
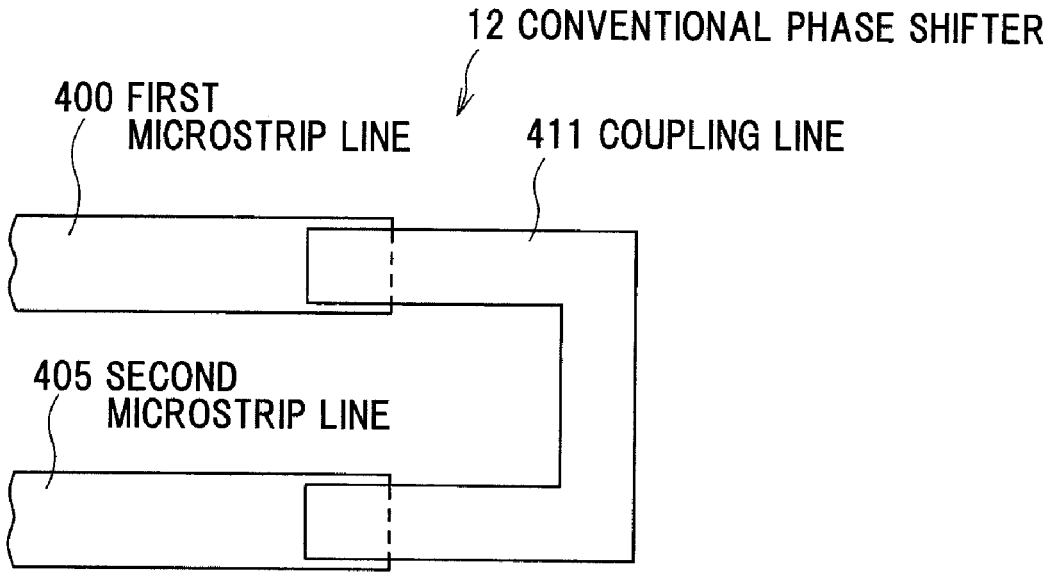
FIG.4A PRIOR ART
Figure 4B:
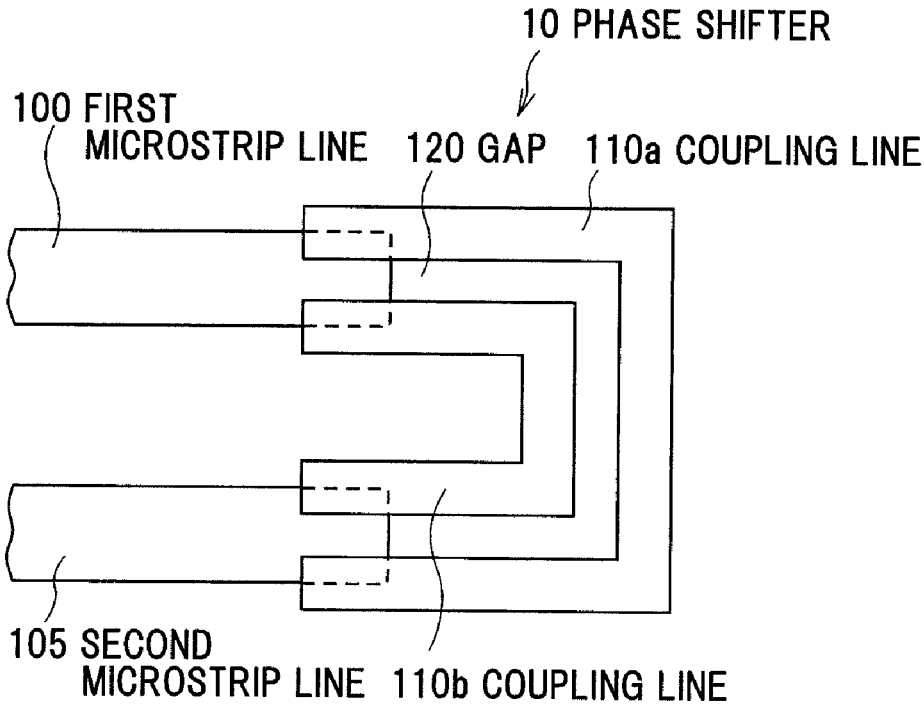

FIG. 4A is a schematic diagram of the conventional phase shifter, and FIG. 4B is a schematic diagram of the phase shifter in the first preferred embodiment.

Figure 5A:
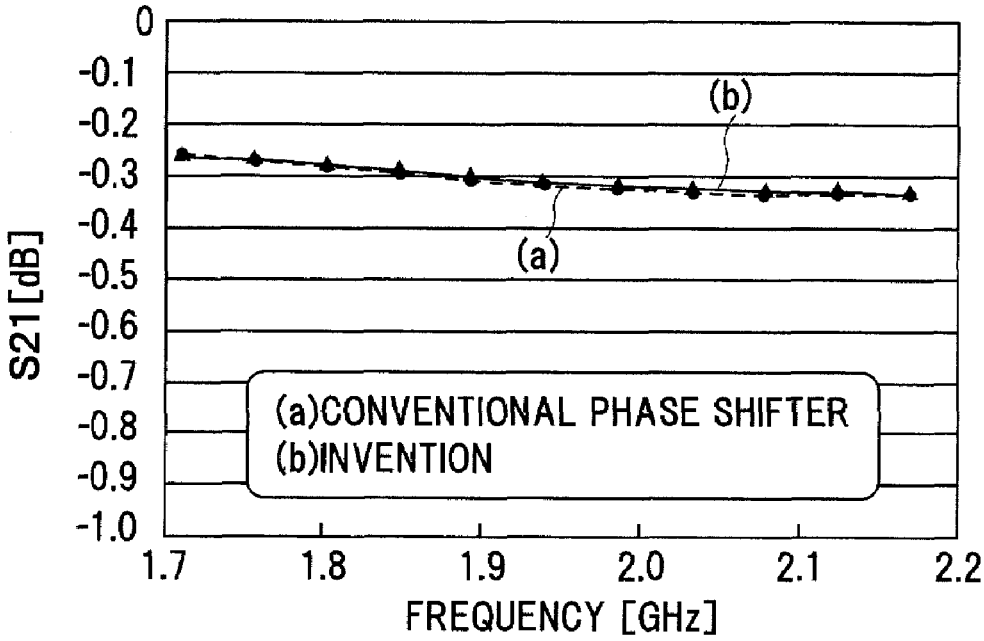
Figure 5B:
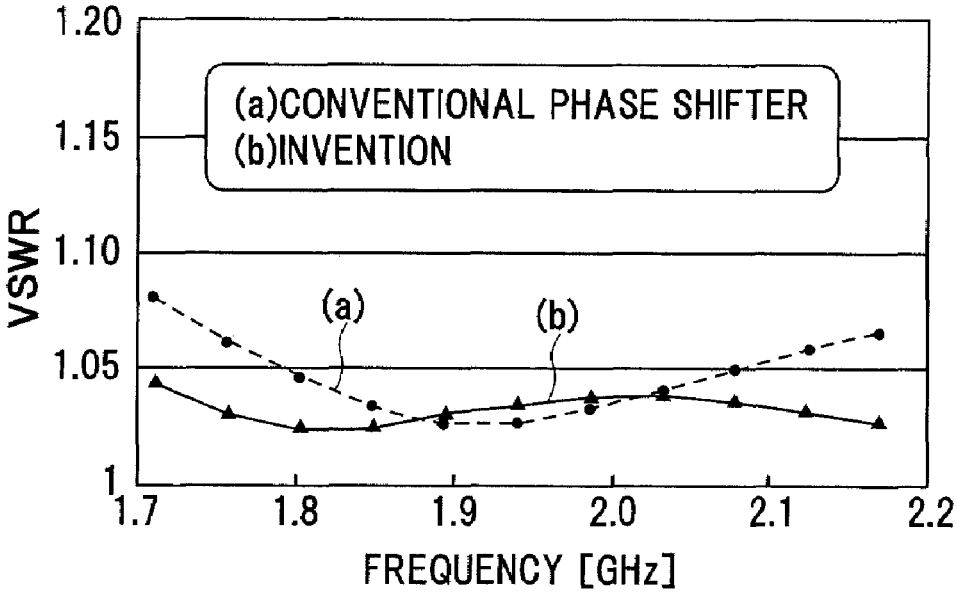

FIG. 5A is a graph showing comparison between transmission characteristics (S21) of a conventional phase shifter (a) and transmission characteristics (S21) of the phase shifter in the first preferred embodiment (b) vs. frequency in GHz, and FIG. 5B is a graph showing a comparison between the voltage standing wave ratio (VSWR) of the conventional phase shifter (a) and the VSWR of the phase shifter in the first preferred embodiment (b) vs. frequency GHz.

In FIGS. 4A and 4B, for the purpose of simplifying the explanation, illustration of several elements constituting the phase shifter 10 and a conventional phase shifter 12 (FIG. 4A), except as shown in FIG. 4B the first microstrip line 100, the second microstrip line 105, and the coupling lines (the coupling line 411, the coupling line 110*a*, and the coupling line 110*b*) that are necessary for explaining an operation of the phase shifter 10, is omitted.

As shown in FIG. 4A, in the conventional phase shifter 12, the coupling line 411 for electrically coupling the first microstrip line 400 to the second microstrip line 405 is not provided with the gap. On the other hand, as shown in FIG. 4B, the phase shifter 10 in this preferred embodiment comprises the coupling line 110*a* and the coupling line 110*b* having different path lengths formed by the gap 120.

Firstly, the graph in FIG. 5A shows a simulation result of the transmission characteristics (S21) when a predetermined radio frequency signal is transmitted through each of the conventional phase shifter 12 (FIG. 4A) and the phase shifter 10 (FIG. 4B) in this preferred embodiment. In other words, the graph in FIG. 5A shows a proportion of a transmission wave emitted from the phase shifter 10 (FIG. 4B) and the conventional phase shifter 12 (FIG. 4A) to a radio frequency wave (signal) input to the phase shifter 10 (FIG. 4B) and the conventional phase shifter 12 (FIG. 4A), respectively.

An ideal transmission characteristic of the radio frequency wave, which is input to the phase shifter and output from the phase shifter, is 0 dB. According to the phase shifter 10 in this preferred embodiment, it is understood from the graph that the transmission characteristic is within a range from about −0.25 dB to about −0.33 dB, when the frequency is within a range from about 1.7 GHz to about 2.2 GHz (solid line (b) in the graph). In addition, according to the phase shifter 10 in this preferred embodiment, the transmission characteristic is improved at least when the frequency is within a range from about 1.9 GHz to about 2.1 GHz, compared with the conventional phase shifter 12. In other words, according to the phase shifter 10 in this preferred embodiment, a loss of the radio frequency signal that is input to the phase shifter 10 is smaller than that in the conventional phase shifter 12.

Next, the graph in FIG. 5B shows a simulation result of VSWR when the predetermined radio frequency signal is transmitted through each of the conventional phase shifter 12 (FIG. 4A) and the phase shifter 10 (FIG. 4W) in this preferred embodiment.

When the radio frequency signal input to the phase shifter passes through the phase shifter, a value of VSWR is 0 in an ideal state that no radio frequency signal is reflected in the phase shifter. According to the phase shifter 10 in this preferred embodiment, the value of VSWR is not greater than 1.05 when the frequency is within a range from about 1.7 GHz to about 2.2 GHz. Therefore, the value of VSWR of the phase shifter 10 is approximate to 1 in comparison with the conventional phase shifter 12. In other words, according to the phase shifter 10 in this preferred embodiment, the loss of the radio frequency signal due to the reflection of the radio frequency signal in the phase shifter 10 can be reduced compared with the conventional phase shifter 12. Therefore, for example, according to the phase shifter 10 in this preferred embodiment, it is possible to improve the transmission characteristics and the return loss of a communication apparatus using a wideband frequency such as an antenna for a portable telephone base station.

Furthermore, according to the phase shifter 10 in this preferred embodiment, it is understood from the graph 302 that a dispersion of the values of VSWR is reduced in the frequency band from about 1.7 GHz to about 2.2 GHz compared with the conventional phase shifter 12. In addition, by providing n (n is a positive integer) of gaps in the coupling line along the transmitting direction of the signal, (n+1) of the coupling lines are formed (the number of the coupling lines is n+1). This configuration provides different resonant frequencies corresponding to each of (n+1) of the coupling lines. Therefore, it is possible to further reduce the dispersion of the values of VSWR by further increasing the number of the gaps provided in the coupling line along the transmitting direction of the signal.

(Variations of the Coupling Line)

FIGS. 6A to 6D are schematic diagrams of coupling lines in first to fourth variations of the first preferred embodiment.

In FIGS. 6A to 6D, the structure and the function of the phase shifter are substantially the same as those in the phase shifter 10 explained in conjunction with FIGS. 1A, 1B, 2A, 2B, 3, 4A, 4B, 5A and 5B, except the shapes of the coupling lines. Therefore, detailed explanation is omitted. Further, in FIGS. 6A to 6D, illustration of the elements, except the first microstrip line 100, the second microstrip line 105, and the coupling lines that are necessary for explaining the first to fourth variations, is omitted.

Figure 6B:
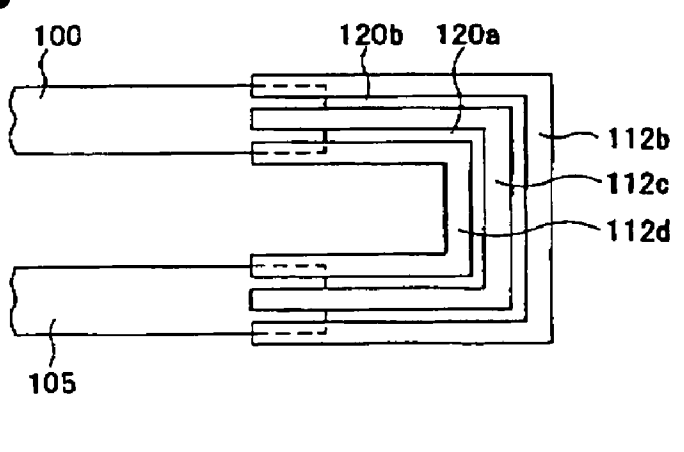
FIGS. 6A to 6D are schematic diagrams of coupling lines in variations of the first preferred embodiment.
Figure 6A:
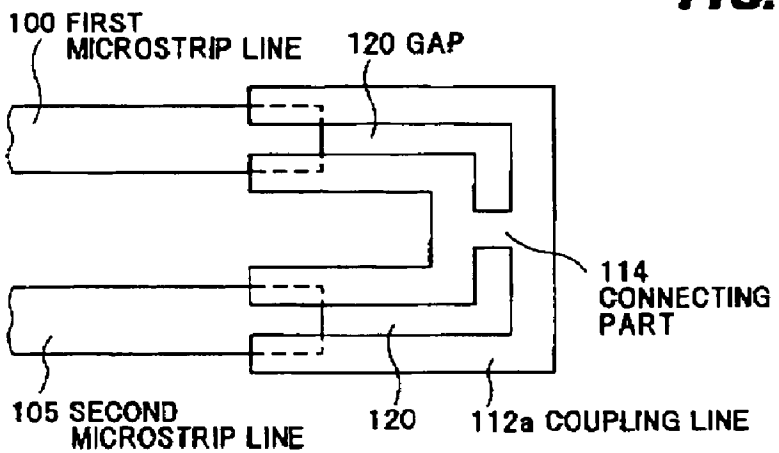

In the first variation as shown in FIG. 6A, the coupling line 112*a* comprises the gap 120 along the transmitting direction of the signal and a connecting part 114 for intervening the gap 120 in the middle of the gap 120, at a region extending from a region capacitively-coupled to the first microstrip line 100 to a region capacitively-coupled to the second microstrip line 105. In the first variation, a location for providing the connecting part 114 is a middle point between one end of the region capacitively-coupled to the first microstrip line 100 and another end of the region capacitively-coupled to the second microstrip line 105. However, the position of the connecting part 114 is not limited to the middle point, and the connecting part 114 may be disposed at other locations. In addition, the shape, length, and width of the connecting part 114 may be appropriately changed.

In the second variation as shown in FIG. 6B, a gap 120*b* is provided between the coupling line 112*b* and the coupling line 112*c*, and a gap 120*a* is provided between the coupling line 112*c* and the coupling line 112*d*. An input signal transmitting through the first microstrip line 100 is divided into three divided signals, and the three divided signals are transmitted through in each of the coupling line 112*b*, the coupling line 112*c* and the coupling line 112*d*.

According to this structure, the coupling line 112*b*, the coupling line 112*c* and the coupling line 112*d* are provided as three U-shaped coupling lines having different path lengths formed by the gap 120*a* and the gap 120*b* in the second variation. Therefore, the resonant frequencies in the coupling line 112*b*, the coupling line 112*c* and the coupling line 112*d* are different from each other, so that the dispersion of the values of VSWR is further reduced compared with the phase shifter comprising the coupling line with a single gap 120.

In the second variation, the number of the gaps is two, however, the present invention is not limited thereto. The number of the gaps may be further increased. The number of coupling lines having different path lengths is increased in accordance with the increase in the number of the gaps provided along the transmitting direction of the signal. When the coupling lines having different path lengths are increased in number, the resonant frequencies in the respective coupling lines are different from each other. As a result, the number of the resonant frequencies is increased, so that the dispersion of the values of VSWR is further reduced compared with the phase shifter comprising the coupling line with a single gap 120.

Figure 6D:
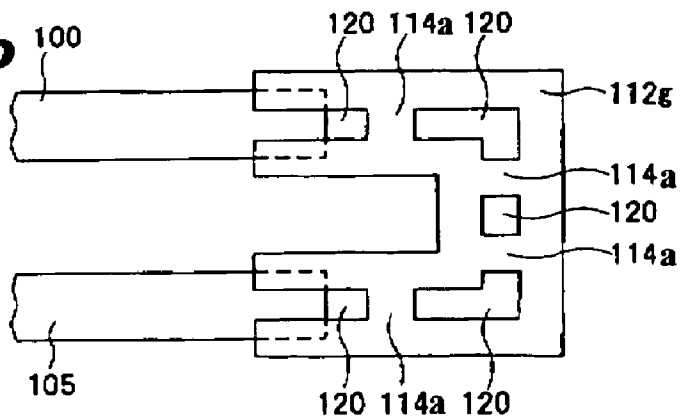
Figure 6C:
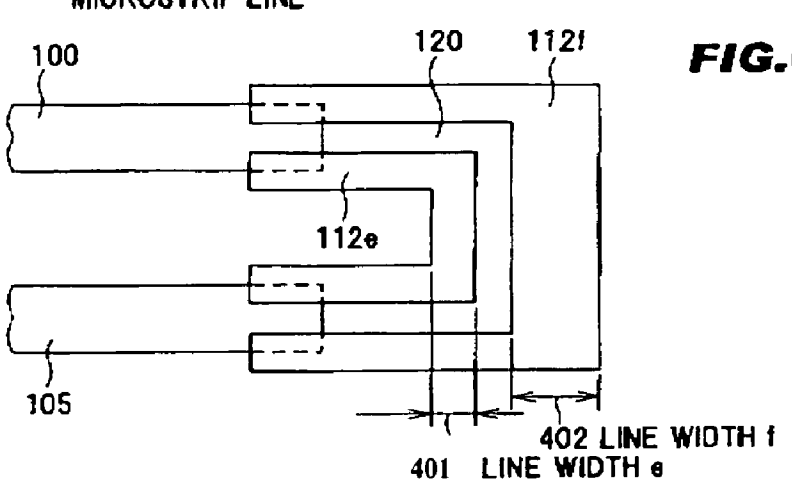

In the third variation shown in FIG. 6C, a line width e 401 of a coupling line 112*e* having a U-shape is constant from one end to another end of the coupling line 112*e*. On the other hand, in a coupling line 112*f*, a line width f 402 is equal to the line width e 401 at a part provided in parallel with the first microstrip line 100 and the second microstrip line 105, and the line width f 402 is greater than the line width e 400 at a part in perpendicular to the first microstrip line 100 and the second microstrip line 105.

The line width of the coupling line of the present invention is not limited to the line width in the third variation. For example, the line width of the coupling line 112*e* may be different from the line width of the coupling line 112*f* at the part provided in parallel with the first microstrip line 100 and the second microstrip line 105. Further, the line width e 400 of the coupling line 112*e* may be varied from one end to another end of the coupling line 112*e*, and the line width f 402 of the coupling line 112*f* may be varied from one end to another end of the coupling line 112*f*. In addition, a part of the gap 120 between the coupling line 112*e* and the coupling line 112*f* may be provided with a connecting part between the coupling line 112*e* and the coupling line 112*f*.

In the fourth variation shown in FIG. 6D, a coupling line 112*g* comprises a plurality of gaps 120 each having a substantially rectangular shape along the direction of the signal transmitting through the coupling line 112*g*. In other words, the coupling line 112*g* comprise a plurality of the gaps 120 formed by a plurality of connecting parts 114*a* that intervenes between the coupling line 112*g* positioned inside and the coupling line 112*g* positioned outside. In addition, the number of the gaps 120 is not limited to the fourth variation. Further, the shape of the gap 120 is not limited to be substantially rectangular, and may be substantially polygonal or substantially circular.

Effect of the First Preferred Embodiment

According to the phase shifter 10 in this preferred embodiment, the coupling line 110*a* and the coupling line 110*b* having different path lengths are provided by forming the gap 120 in the coupling line having the turn-back portion, thereby providing a plurality of the signal transmission paths. According to this structure, there is a difference between a traveling distance of the signal transmission path in the coupling line 110*a* and a traveling distance of the signal transmission path in the coupling line 110*b*, so that the resonant frequency for the coupling line 110*a* and the resonant frequency for the coupling line 110*b* are different from each other. In other words, by forming the coupling line 110*a* and the coupling line 110*b*, the resonant frequencies for the respective coupling lines are increased, so that it is possible to broaden the frequency band of the signal subject to the phase shifting by the phase shifter 10.

In addition, according to the phase shifter 10 in this preferred embodiment, the phase shifter upper part 2 provided with a plurality of the coupling lines, which are capacitively-coupled to the first microstrip line 100 and the second microstrip line 105 respectively can be freely dislocated with respect to the phase shifter lower part 1 provided with the first microstrip line 100 and the second microstrip line 105, in a direction parallel to the first microstrip line 100 and the second microstrip line 105. Accordingly, it is possible to vary the path length of the signal transmitting through each of the coupling lines, so that it is possible to freely vary the phase of the signal transmitting through each of the coupling lines.

Second Preferred Embodiment

Figure 7:
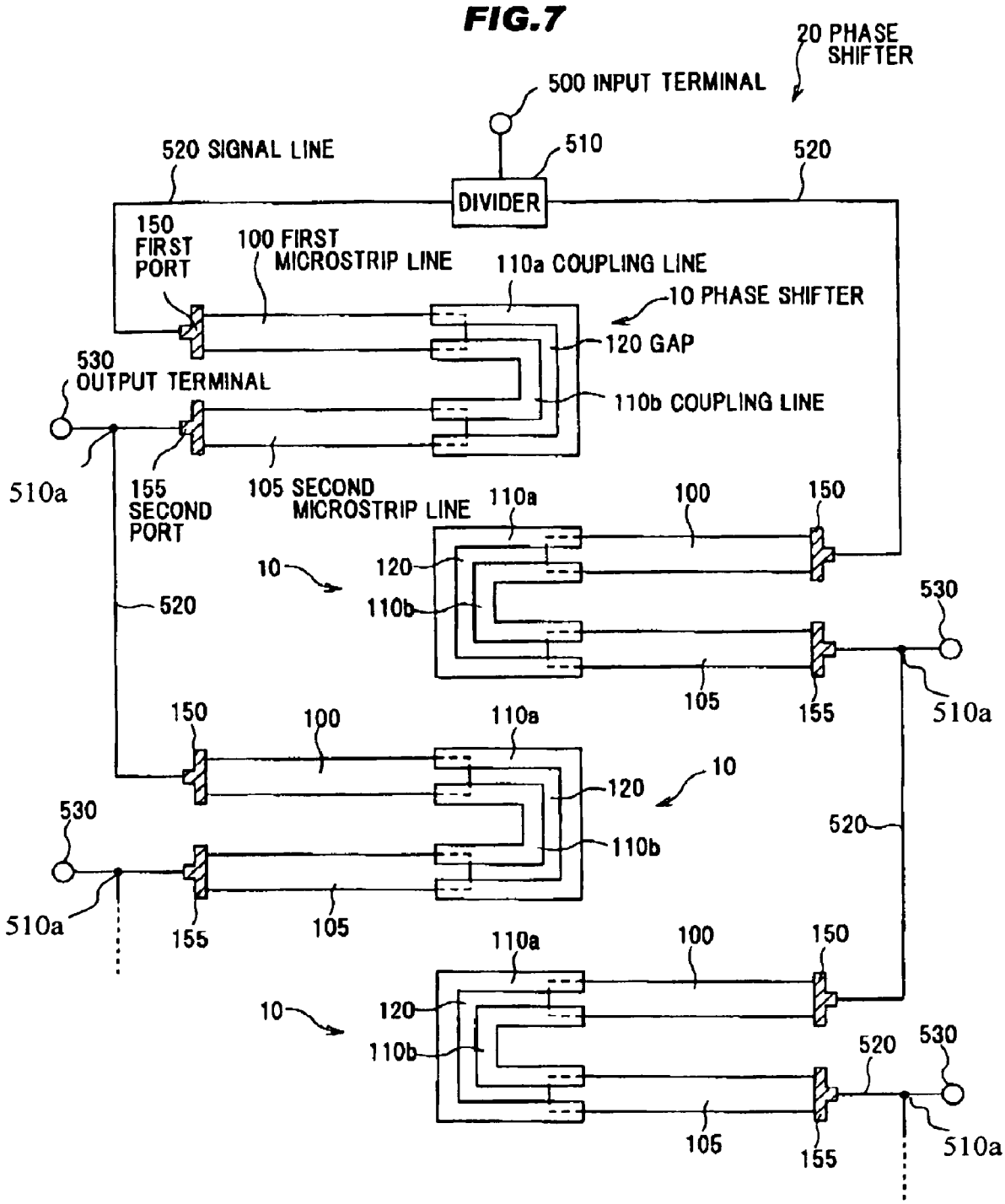
FIG. 7 is a schematic diagram showing a configuration of a phase shifter in a second preferred embodiment according to the present invention.

FIG. 7 is a schematic diagram showing an example of a structure of a phase shifter in a second preferred embodiment according to the present invention.

In FIG. 7, for the purpose of simplifying the explanation for the purpose of simplifying the explanation, illustration of several elements constituting the phase shifter 10, except the first microstrip line 100, the second microstrip line 105, the coupling line 110*a*, and the coupling line 110*b*, is omitted.

(Structure of the Phase Shifter 20)

In this preferred embodiment, a phase shifter 20 comprises a plurality of the phase shifters 10. Since the phase shifter 10 in the second preferred embodiment has substantially similar structure, function and effect to those of the phase shifter 10 explained in conjunction with FIGS. 1A to 5B, and FIGS. 6A to 6D, the detailed description of the phase shifter 10 is omitted here.

In concrete, the phase shifter 20 comprises an input terminal 500 to which a predetermined input signal is input, a divider 510 for distributing the input signal input to the input terminal 500 into a plurality of distributed signals, a plurality of signal lines 520 for transmitting the distributed signals distributed by the divider 510 to a plurality of the phase shifters 10, respectively, a plurality of the phase shifters 10, each of which converts a phase of the distributed signal input from a first port 150 via the signal line 520 into a predetermined phase and outputs the signal with the predetermined phase, and a plurality of output terminals 530 for outputting the signal output from a second port 155 of each of the phase shifter 10 to the outside of the phase shifter 20.

The respective phase shifters 10 may be connected with each other, such that the second port 155 of one of the phase shifters 10 is connected to the first port 150 of other one of the phase shifters 10. In this case, the phase shifter 20 may further comprise another divider (not shown) for distributing the signal output from one phase shifter 10 into plural signals, provided between the second port 155 of the one phase shifter 10 and the first port 150 of the other phase shifter 10.

(Operation of the Phase Shifter 20)

The divider 510 distributes a radio frequency signal input to the input terminal 500 into two distributed signals. The divider 510 transmits one of the distributed radio frequency signals to the first port 150 of the first phase shifter 10 through the signal line 520, and transmits another of the distributed radio frequency signals to the first port 150 of the second phase shifter 10 through the signal line 520.

In each of the first and second phase shifters 10, a part of the distributed signals distributed by the divider 510 is input to the first port 150. In each of the first and second phase shifters 10, the distributed signal input to the first port 150 is transmitted through the first microstrip line 100. The distributed signals transmitted through the first microstrip line 100 is divided into a plurality of divided signals at a predetermined region of the coupling line 110*a* and the coupling line 110*b* separated by gap 120 and that are electrically connected to the first microstrip line 100. The divided signals generated by dividing the distributed signal are transmitted through the coupling line 110*a* and the coupling line 110*b* respectively.

In each of the first and second phase shifters 10, the phase of each of the divided signals input from the first microstrip line 100 is shifted in each of the coupling line 110*a* and the coupling line 110*b*, and the phase-shifted divided signals are output to the second microstrip line 105. Each of the divided signals that are phase shifted in each of the coupling line 110*a* and the coupling line 110*b* is transmitted through the second microstrip line 105 and output to the second port 155.

In each of the first and second phase shifters 10, the second port 155 supplies each of the divided signals transmitted through the second microstrip line 105 to the output terminal 530 which is connected to the second port 155. Each of the output terminals 530 receives the divided signals transmitted through the second microstrip line 105 from the second port 155 connected to the output terminal 530, and outputs the divided signals to the outside of the phase shifter 20.

In a case that the second port 155 of the first phase shifter 10 is connected to a third phase shifter 10 via a further divider 510*a* and the signal line 520, another divider receives the divided signals from the second port 155 of the first phase shifter 10. The further divider divides the divided signals received from the first phase shifter 10 into a plurality of partial divided signals (segment signals). Subsequently, the further divider outputs a part of the segment signals to the output terminal 530 as a part of the divided signals, and outputs another part of the segment signals to a first port 150 of the third phase shifter 10 as the distributed signal.

In a case that the second port 155 of the second phase shifter 10 is connected to a fourth phase shifter 10 via a further divider 510*a* and the signal line 520, the structure, function and effect thereof are similar to those in the example that the first and third phase shifters 10 are connected via another divider and the signal line 520, so that the detailed description is omitted. The divider 510 may distribute the radio frequency signal input to the input terminal 500 into three or more signals. In this case, the divider 510 outputs each of the distributed radio frequency signals to different phase shifters 10 via the signal lines 520.

Effect of the Second Preferred Embodiment

The phase shifter 20 in this preferred embodiment distributes the signal output from one phase shifter 10, and supplies a part of the distributed signals to another phase shifter 10, thereby realizing a multi-stage configuration provided with a plurality of the phase shifters 10. According to this structure of the phase shifter 20, it is possible to shift the phase of the signal in each of the phase shifters 10, to output the signals with different phases from the respective phase shifters 10. Therefore, it is possible to control the phase of a multi-element antenna such as an array antenna by providing the phase shifter 20.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A phase shifter, comprising:

an input terminal to which a predetermined input signal is input;

a distributor for distributing the predetermined input signal into a plurality of distributed signals; and a plurality of phase shifters for converting a phase of each of the distributed signals into a predetermined phase, each of the phase shifters comprising:

a first port to which at least one of the plurality of distributed signals is input;

a first microstrip line for transmitting a part of the distributed signals input to the first input port;

a coupling line including a plurality of paths having different path length provided by a gap along a transmission direction of the part of the distributed signals, the paths being electrically coupled to the first microstrip line at a first region, for transmitting each of divided signals generated by dividing the part of the distributed signals by the gap through each of the paths; and a second microstrip line provided in parallel with the first microstrip line and electrically coupled to the coupling line at a second region, for transmitting the divided signals transmitted through the coupling line, wherein the coupling line of each of the phase shifters is provided on a dielectric substrate provided to be freely movable along the first microstrip line and the second microstrip line.

2. The phase shifter, according to claim 1, wherein the coupling line included in each of the phase shifters comprises a conductive material provided on the dielectric substrate, and the conductive material is insulated for a direct current between the first microstrip line and the second microstrip line.

3. The phase shifter, according to claim 2, wherein the conductive material comprises a metal foil or a metal plate.

4. A phase shifter, comprising:

a first microstrip line for transmitting an input signal;

a coupling line including a plurality of paths having different path lengths provided by a gap along a transmitting direction of the input signal, the paths being electrically coupled to the first microstrip line at a first region, for transmitting each of divided signals generated by dividing the input signal by the gap through each of the paths; and a second microstrip line provided in parallel with the first microstrip line and electrically coupled to the coupling line at a second region, for transmitting each of the divided signals transmitted through the coupling line, wherein the coupling line is provided on a dielectric substrate provided to be freely movable along the first microstrip line and the second microstrip line.

5. The phase shifter, according to claim 4, wherein the coupling line comprises a conductive material provided on the dielectric substrate, the conductive material is insulated for a direct current between the first microstrip line and the second microstrip line.

6. The phase shifter, according to claim 5, wherein the conductive material comprises a metal foil or a metal plate.

7. A phase shifter, comprising:

an input terminal to which a predetermined input signal is input;

a distributor for distributing the input signal into a plurality of distributed signals; and a plurality of phase shifters for converting a phase of each of the distributed signals into a predetermined phase, each of the phase shifters comprising:

a first port to which at least one of the plurality of distributed signals is input;

a first microstrip line for transmitting a part of the distributed signals input to the first port;

a coupling line including a plurality of paths having different path length provided by a gap along a transmission direction of the part of the distributed signals, the paths being electrically coupled to the first microstrip line at a first region, for transmitting each of divided signals generated by dividing the part of the distributed signals by the gap through each of the paths;

a second microstrip line provided in parallel with the first microstrip line and electrically coupled to the coupling line at a second region, for transmitting the divided signals transmitted through the coupling line, an output terminal for outputting at least a part of the divided signals transmitted through the second microstrip line;

each of the plurality of the phase shifters further comprising:

a second port for outputting each of the divided signals transmitted through the second microstrip line to a divider, the divider dividing each of the divided signals into plural partial divided signals, outputting a part of the partial divided signals to the output terminal as a part of the divided signals, and outputting another part of the partial divided signals to the first port of another phase shifter as a distributed signal, wherein the coupling line of each of the phase shifters is provided on a dielectric substrate provided to be freely movable along the first microstrip line and the second microstrip line.

* * * * *

UNITED STATES PATENT AND TRADEMARK OFFICE

CERTIFICATE OF CORRECTION

PATENT NO. : 7,623,008 B2
APPLICATION NO. : 11/968928
DATED : November 24, 2009
INVENTOR(S) : Shinsuke Murano It is certified that error appears in the above-identified patent and that said Letters Patent is hereby corrected as shown below:

On the title page item (75) of the Patent the Inventor's name should read:

Shinsuke Murano, Kasama (JP)

Signed and Sealed this

Twenty-third Day of February, 2010

David J. Kappos

David J. Kappos
*Director of the United States Patent and Trademark Office*